US007784759B2

(12) United States Patent
Farrell

(10) Patent No.: US 7,784,759 B2
(45) Date of Patent: Aug. 31, 2010

(54) INSULATED SINGLE BEVERAGE CONTAINER COOLER/HOLDER

(75) Inventor: Edwin B. Farrell, 3667 Fox Den Ct., Saline, MI (US) 48176

(73) Assignee: Edwin B. Farrell, Saline, MI (US)

( * ) Notice: Subject to any disclaimer, the term of this patent is extended or adjusted under 35 U.S.C. 154(b) by 340 days.

(21) Appl. No.: 11/217,244

(22) Filed: Sep. 1, 2005

(65) Prior Publication Data

US 2006/0043250 A1 Mar. 2, 2006

Related U.S. Application Data

(60) Provisional application No. 60/606,393, filed on Sep. 1, 2004.

(51) Int. Cl.
*A47F 5/00* (2006.01)
*B65D 25/00* (2006.01)

(52) U.S. Cl. ..... 248/315; 62/457.4; 215/232; 220/592.16; 220/739; 248/311.2; 248/314

(58) Field of Classification Search ..... 248/311.2, 248/312, 312.1, 314, 309.1; 220/592.16, 220/592.17, 739, 529.25, 703, 737, 740, 220/903, 906; 62/457.3, 457.4; 215/53, 215/231, 232, 274
See application file for complete search history.

(56) References Cited

U.S. PATENT DOCUMENTS

| | | | | |
|---|---|---|---|---|
| 3,257,025 | A | 6/1966 | Jolly | |
| 3,302,428 | A | 2/1967 | Stoner et al. | |
| 3,766,975 | A | 10/1973 | Todd | |
| 3,995,445 | A | 12/1976 | Huskins | |
| 4,293,015 | A | 10/1981 | McGough | |
| 4,299,100 | A | 11/1981 | Crisman et al. | |
| 4,383,422 | A | 5/1983 | Gordon et al. | |
| 4,577,474 | A | 3/1986 | Peterson | |
| 4,596,370 | A * | 6/1986 | Adkins | 248/311.2 |
| 4,638,645 | A | 1/1987 | Simila | |
| 4,681,239 | A | 7/1987 | Manns et al. | |
| 4,720,023 | A * | 1/1988 | Jeff | 220/592.17 |
| 4,771,911 | A | 9/1988 | Morony et al. | |
| 4,782,670 | A * | 11/1988 | Long et al. | 62/457.4 |
| 4,793,149 | A | 12/1988 | Riche | |
| 4,798,063 | A | 1/1989 | Rimmer | |
| 5,067,329 | A | 11/1991 | Tomlinson | |
| 5,253,780 | A * | 10/1993 | Adado | 220/711 |
| 5,361,604 | A | 11/1994 | Pier et al. | |
| 5,467,891 | A * | 11/1995 | Perry | 220/739 |
| 6,398,061 | B2 | 6/2002 | Duff et al. | |
| 6,516,967 | B2 * | 2/2003 | Duff et al. | 220/592.16 |
| 6,585,127 | B2 * | 7/2003 | Yang | 220/23.86 |

(Continued)

*Primary Examiner*—Amy J Sterling
*Assistant Examiner*—Tan Le
(74) *Attorney, Agent, or Firm*—Reising Ethington P.C.

(57) ABSTRACT

An insulated beverage holder formed from neoprene and including a seal located at the upper opening of the housing. The seal can extend above the housing and can include an upper insertion portion and a lower sealing portion. The insertion portion helps ease the insertion of a beverage container into the holder and the sealing portion produces a watertight seal of the holder to the beverage container. An ice and water mixture can be placed into the holder prior to inserting the beverage container to provide cooling of the beverage while it is being consumed.

9 Claims, 12 Drawing Sheets

U.S. PATENT DOCUMENTS

| | | | | |
|---|---|---|---|---|
| 6,588,621 | B2 | 7/2003 | Shimazaki | |
| 6,705,110 | B1 | 3/2004 | Worsham | |
| 6,786,062 | B1 | 9/2004 | Greenberg | |
| 6,814,252 | B2 | 11/2004 | Murakami et al. | |
| 2002/0014491 | A1* | 2/2002 | Duff et al. | 220/592.16 |
| 2006/0043250 | A1* | 3/2006 | Farrell | 248/311.2 |
| 2007/0090256 | A1* | 4/2007 | Hansen et al. | 248/311.2 |

* cited by examiner

INSULATED SINGLE BEVERAGE CONTAINER COOLER/HOLDER

CROSS-REFERENCE TO RELATED APPLICATION

This application claims the priority of U.S. Provisional Application No. 60/606,393, filed Sep. 1, 2004, the entire contents of which are hereby incorporated by reference.

TECHNICAL FIELD

This invention relates generally to holders for beverage containers such as bottles and cans, and more particularly to cooling and insulating beverage holders designed to either chill a beverage or reduce temperature changes of a beverage in the beverage container.

BACKGROUND OF THE INVENTION

The majority of beverage container holders have been designed for either 12 oz cans or 12 oz bottles. Recently, the popularity of water bottles has created a market for bottle holders that can fit 16-25 oz and greater water bottles. The term beverage container is not limited to the typical twelve ounce bottle or can and may include water bottles, soda bottles, plastic squeeze bottles and even plastic cups or glass drinkware. The use of a cup or glass is useful when it is desirable to have a non-dilutive means of cooling a beverage (ice in a beverage melts over time diluting the beverage).

Existing beverage holders can be grouped into at least the following categories according to their construction and how they achieve the result.

Insulators—typically manufactured from neoprene (chloroprene) or SBR (styrene butadiene rubber) closed cell foam rubber, they are designed to lessen the rate of warming of a chilled beverage. The insulator holder is cylindrical in shape with an inside diameter slightly bigger than the intended beverage container to allow easy insertion and removal of the beverage container. Given the variance in diameter of the average can from the average 12 oz bottle, current beverage holder manufacturers generally create two versions of holders—one that fits cans and one that fits bottles. The can version has a very simple construction—a cylindrical tube with a bottom; the height of holder is less than the height of can to ensure that a portion of the can is visible and reachable for easy removal of the can from the holder when the can is completely inserted into the holder (i.e. the can's bottom is in contact with the interior bottom of the holder). The 12 oz bottle version is only slightly more complicated—a cylindrical tube, a bottom, and a tapering neck with a zipper to snugly fit the neck of a 12 oz bottle. The water bottle versions often have a draw string around the top opening to secure the bottle and provide greater coverage of the bottle to lessen warming. The primary shortcoming of this design is that it only insulates but does not provide any cooling to the beverage. The insulators—particularly ones intended for cans—often have a hole in the bottom to prevent build up of pressure or a vacuum during insertion and removal of the container, respectively. Regardless of whether this bottom hole is used or not, these types of insulating holders usually do not provide watertight sealing between the container and holder. In addition, the insulators typically have seams that are not watertight—particular where the bottom is attached to the cylindrical side. In the case of ones having the bottom hole, water would leak through it. On those without a hole in the bottom, they typically are not made to fit tightly on the container and thus can allow water to leak out between the container and holder. Regardless of whether the holder is intended for use with cans or with bottles, the holders are do not typically provide for a space below the beverage container to accommodate a refrigerant.

Holders with Re-freezable Refrigerant. These typically have a double walled plastic construction with a non-toxic re-freezable liquid or gel contained in the space between the double side walls. The product is chilled in a freezer for about 4 hours prior to use and a bottle or can is inserted in the cylindrical holder to keep the beverage cool. However, this design suffers from several shortcomings including:

(a) Expensive to manufacture—due to high tooling costs for injection molding and/or blow molding dies.

(b) No way to "recharge" quickly—once the refrigerant in the device has warmed to the ambient external air temperate, there is no way to obtain continued cooling of the beverage or cooling of a new beverage without recharging the holder (i.e., make it cold again by putting it back in the freezer) or using another chilled holder. This diminishes the usefulness and the convenience of the product since this type of product is often used outside, for example at a beach, where it is not possible to refreeze the product or, at least very least inconvenient to wait the several hours required to refreeze the refrigerant.

Insulators That Cool beverage With an Ice and Water Mixture. An example of this type of holder is disclosed in U.S. Pat. No. 6,516,967 and is currently marketed by O&D Plastics, Ltd. under the brand name IceTub™. As described in its patent, "The holder includes one or more support ridges, a pedestal, or other beverage container support means to support the bottom of the can or bottle above the holder bottom to create a space for an ice or an ice and water cooling medium. A sealing means between the holder and the beverage container permits the beverage container and the holder to be tipped for drinking without spilling the ice or ice and water used to provide the cooling." The drawbacks of this design include:

(a) Manufacturing Expense—The manufacturing costs of this design can be high due to high tooling costs for injection molding and/or blow molding dies. The product also requires tooling for multiple parts and possibly expensive "overmolding" of parts used in the sealing means.

(b) Limited range of beverage container diameters—due to materials used in sealing. Testing has revealed that the product can leak when used in conjunction with certain national brand beverage bottles such as a "Sam Adams" brand beer bottle.

(c) More expensive to print on. Beverage holders are a very popular promotional item used by companies. Since the most common holders are made of neoprene foam, promotional vendors have equipment designed to print on neoprene. However, it is believed that it is much less common that such vendors have the specialized equipment to print on the type of thermoplastic used for the IceTub™ holder.

(d) Two piece construction. The IceTub has a removable seal that snaps into the top opening of the housing. In the event the seal, which is relatively small, is misplaced, lost or separated from the housing, the product will not work as intended.

SUMMARY OF THE INVENTION

The present invention is directed to an insulated beverage holder formed from neoprene or other insulating material. The holder includes a seal located at the upper opening of the housing. The seal can extend above the housing and can include an upper insertion portion and a lower sealing portion. The insertion portion helps ease the insertion of a beverage container into the holder and the sealing portion produces a watertight seal of the holder to the beverage container. An ice and water mixture can be placed into the holder prior to inserting the beverage container to provide cooling of the beverage while it is being consumed.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
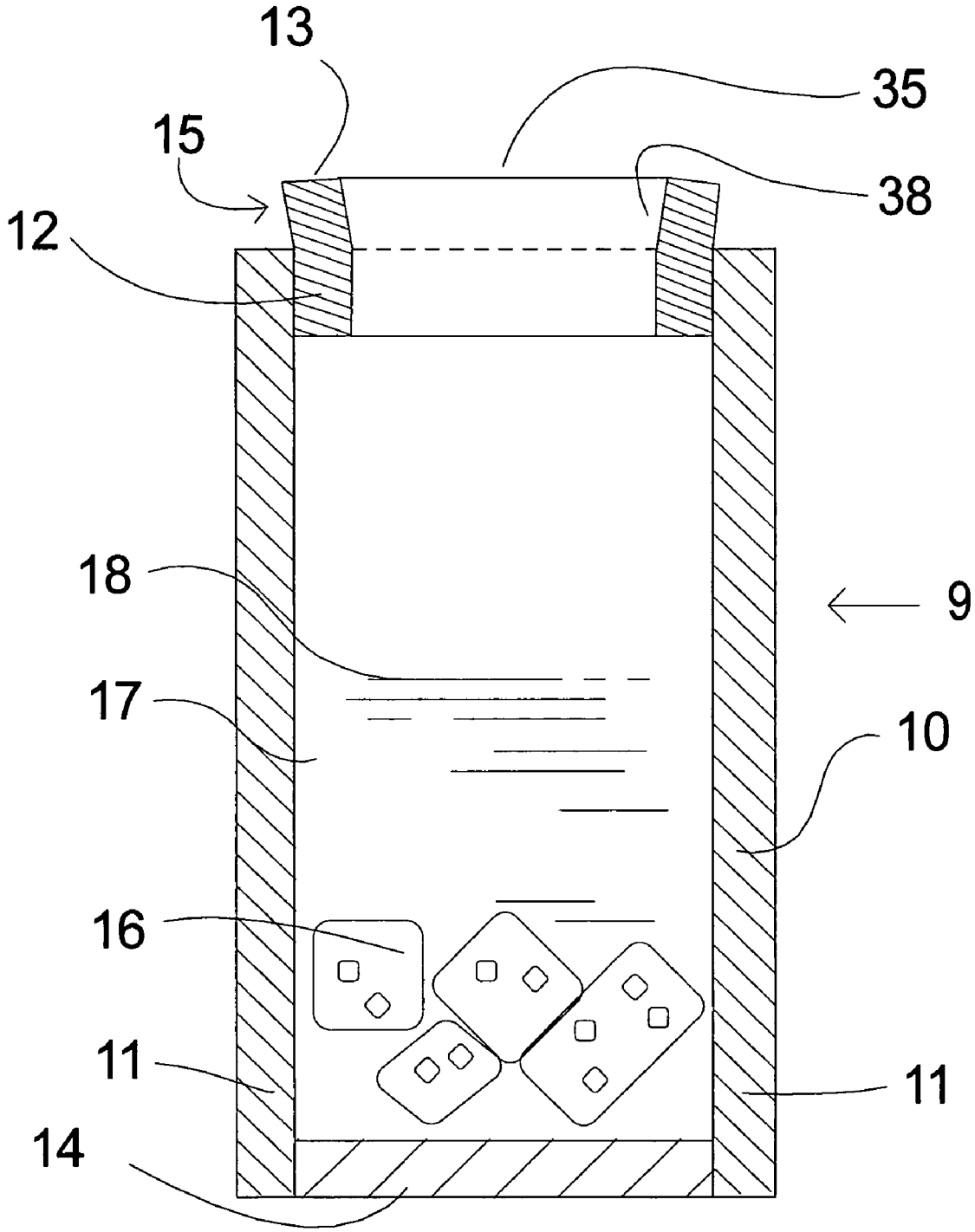
FIG. 1 is a side cut-away orthogonal view of a beverage container holder showing it in use with a 12 oz. can.
Figure 2:
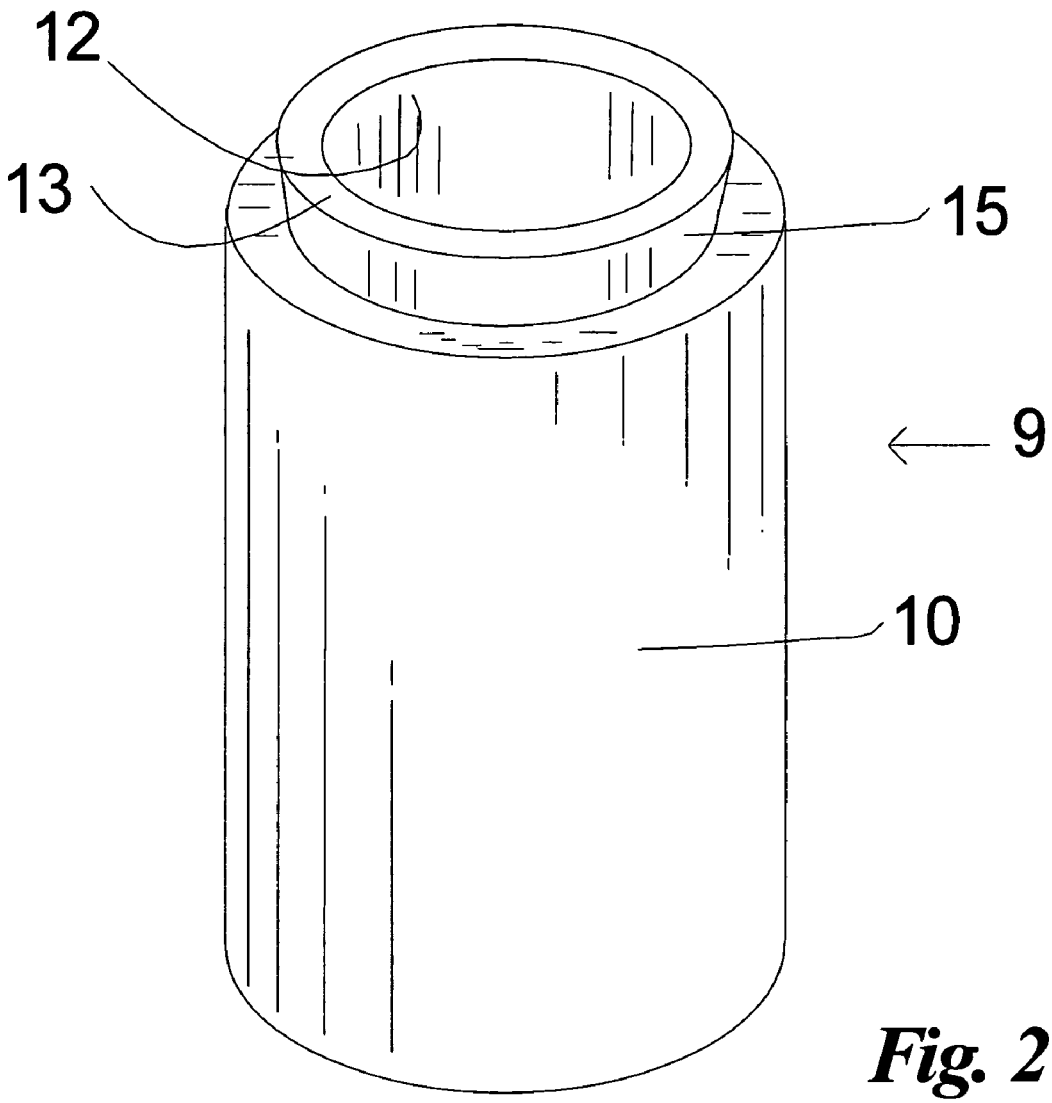
FIG. 2 is a side perspective view of the beverage holder of FIG. 1.
Figure 3:
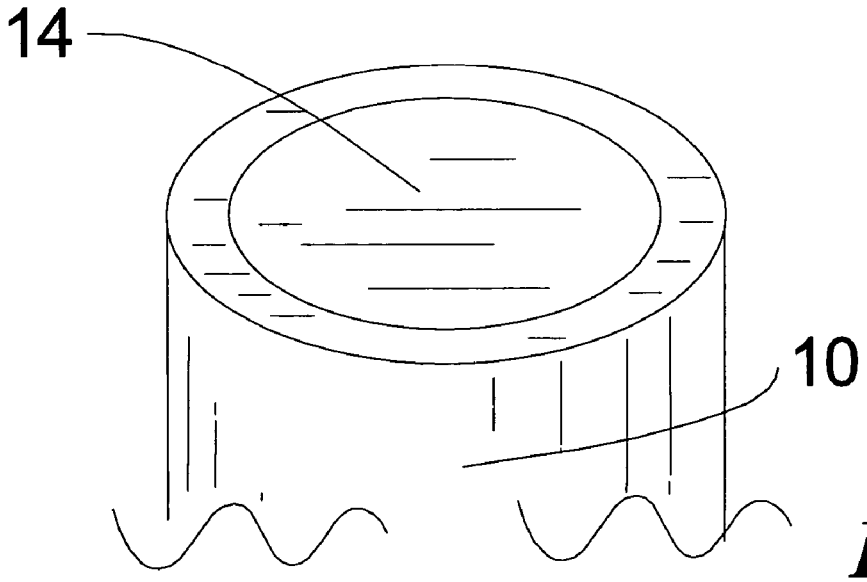
FIG. 3 is a side perspective view of the bottom of the beverage holder of FIG. 1.

With reference to FIGS. 1-4, there is shown a beverage container holder 9 constructed in accordance with the present invention as it might be used for a typical twelve ounce soft drink or beer can 22. The holder's design is comprised of two primary components—a watertight housing 10 and a seal 12. Watertight housing 10 comprises a sleeve 11 with affixed bottom 14. The housing 10 is a hollow cylindrical tube in shape with an open top and a closed bottom. The bottom 14 is permanently attached to the cylindrical side walls 11 of the housing's bottom by adhesive such that a watertight seal is formed. Suitable adhesive is Aquaseal brand adhesive manufactured by McNett corporation located in Bellingham, Wash. (www.mcnett.com). This adhesive preferably extends along the entire annular interface between the side walls 11 and bottom 14. Apart from the adhesive at this interface, a separate bead of suitable watertight adhesive (not shown) may be applied along the inner bottom corner between these two components to aid in sealing the juncture of the side walls 11 with the bottom 14. Alternatively, this bead could be located on the bottom, exterior point of contact between these two components.

The size of the housing 10 depends on the size of the target beverage containers that will be used with it. For example, the housing that is intended for use with 12 oz cans and 16-24 oz water bottles may be a different size from one targeting 8 oz bottles, which have a smaller diameter. The axial length of the housing for a version targeting 12 oz cans and bottles would be about 6 inches with a radial diameter of about 3¼ inches assuming a housing material of ¼ inch thickness. Likewise, wine bottles would require a substantially larger housing both in diameter and overall length. Regardless of the intended beverage container, the inside diameter of the housing should be sufficient for the beverage container to fit within while allowing for an annular space of approximately 1/16 inch to ¼ inch between the outside of the beverage container 22 and the inside surface of the housing 10. Depending on the application and desired thermal characteristics of the holder 9, the width of this space could be made smaller or much larger. The length of housing 10 should be sufficient to allow substantially the length of a beverage container to fit within it in a sleeve-like fashion while allowing approximately 1½ inches of room in the bottom as an open chamber area 17 for the refrigerant, which is introduced prior to the beverage container. This bottom space dimension can also be decreased or increased as necessary or desirable for a particular application. The refrigerant used can be ice 16, chilled water 18, or an ice and water mixture, and preferably the open chamber 17 is only partially filled so that the refrigerant does not completely fill the interior space 17 up to the seal 12—after the beverage container 22 has been inserted. Other known refrigerants can be used as well.

The housing 10 can be made of a stretchable/elastic, resiliently compressible and flexible insulating material such as closed cell foam rubber commonly know as neoprene (chloroprene) or wet suit material. Other closed cell foam rubbers such as SBR (styrene butadiene rubber), or other natural or synthetic rubber-like materials (rubber-like material being a material with the properties of stretch, elongation, bounce, and memory) may also be used. Closed cell foam rubbers are desirable because they meet the fundamental material requirements of elasticity/elongation, resiliently compressible, watertight, and inexpensive. For the sake of the reader, neoprene will be used to mean any closed cell foam rubber—unless otherwise specified. In the preferred embodiment, the housing is constructed of extruded neoprene or SBR tubing of thickness ¼" to ⅜" Whatever synthetic or natural rubber material that is used for the housing 10, it should have a minimum elongation property of 25 percent (i.e. it should be able to stretch to at least 1.25 times its original length without breaking or tearing). In the preferred embodiment, the elongation should be above 50 percent. The bottom 14 ideally uses the same extruded type of neoprene material; however, the bottom material can be solid, extruded neoprene tubing that is "baloney" cut to the appropriate thickness (¼" to ⅜") Housing 10 could optionally be formed from neoprene sheet material; however, it would require an additional step to connect two edges (by fusing, sewing, and/or adhesive) to form the cylindrical shape of the housing. Sheet material for the bottom 14 would simply be die cut in a circular shape of appropriate diameter. Since the bottom 14 material does not require the property of elasticity, closed cell foam materials without significant elasticity can be used, such as EVA foam (ethylene vinyl acetate), or cross-linked polyethylenes such at Minicel® brand by Voltek Inc of Coldwater, Mich.

Figure 4:
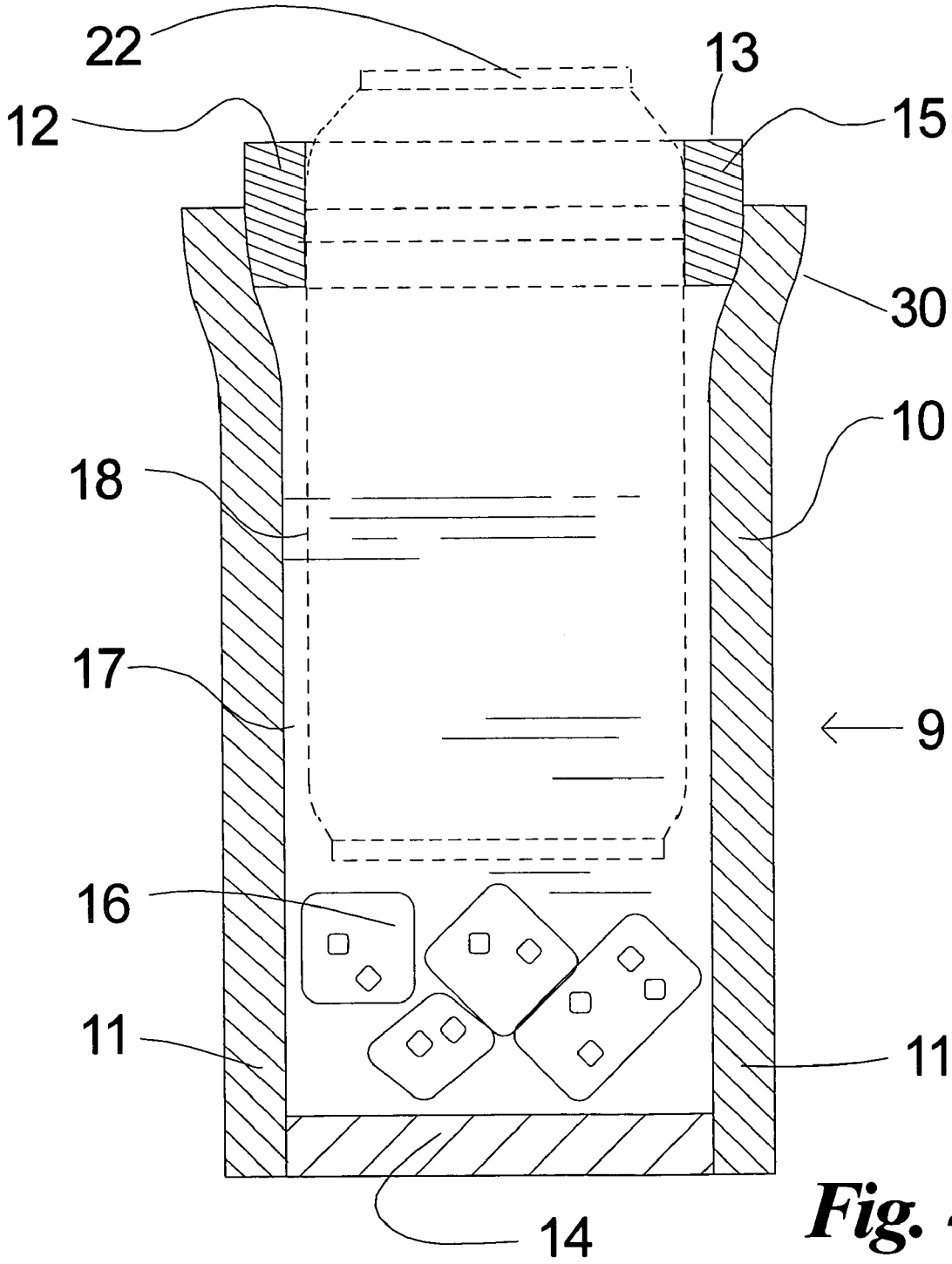
FIG. 4 is a cut-away side view as in FIG. 1 showing a beverage can inserted into the holder of FIG. 1.

The seal 12 is in the shape of a wide ring sized to fit within the housing. It is constructed of a closed cell foam rubber material such as either extruded neoprene tubing "baloney" cut to length or sheet neoprene of appropriate thickness that is die cut to the appropriate dimensions. As indicated in FIG. 1, the outer diameter of the seal 12 is somewhat smaller than the inner diameter of the sleeve 11 so that when attached inside the upper opening of the sleeve 11, the upper portion 15 of the seal 12 flares outwardly which aids in insertion of the beverage container 22. The diameters, thickness dimensions, and relative material characteristics of the sleeve 11 and seal 12 can be selected so that the holder 9 substantially retains the shape shown in FIG. 1 even when a beverage 22 is inserted into the holder, and this can be done as long as a suitable watertight sealing is maintained against the beverage 22. Alternatively, these dimensions and materials can be selected so that the insertion of the can 22 expands the seal 12 and sleeve 11 at the opening, creating a bulge 30 and stronger sealing, as shown in FIG. 4. These features and the relative material characteristics and dimensions are discussed in greater detail below.

Second Embodiment

Figure 5:
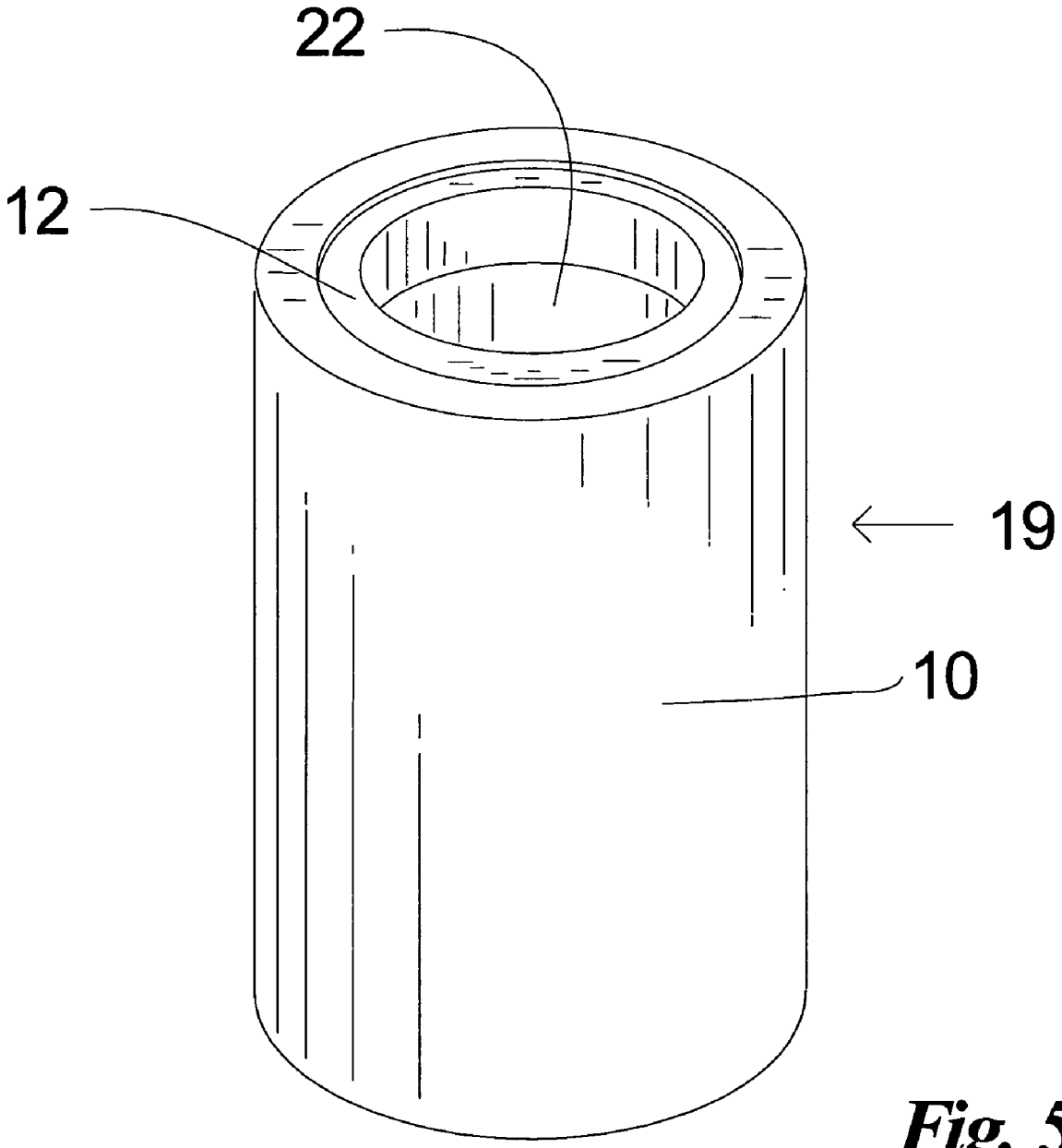
FIG. 5 is view as in FIG. 1 of a second embodiment of the invention.
Figure 6:
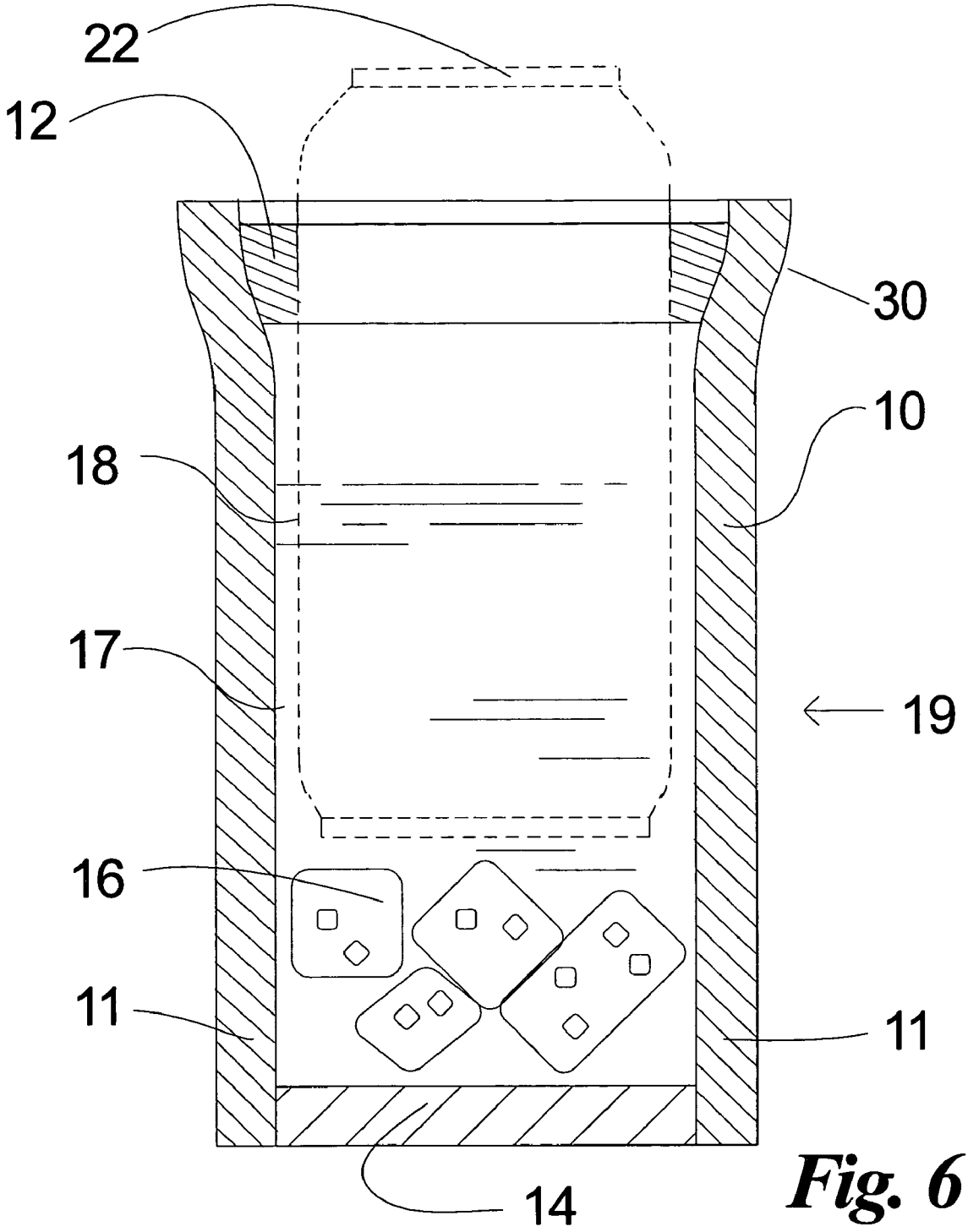
FIG. 6 is a side perspective view of the beverage holder of FIG. 5.

Referring now to FIGS. 5 and 6, a second embodiment 19 is shown in which the same seal 12 is concentrically positioned near the top opening of the housing 10 slightly below the top plane of housing 10. The remaining structural features of this second embodiment can be the same as that disclosed above in connection with FIGS. 1-4. As in that first embodiment, the overall dimensions (width, inside diameter, outside diameter and thickness) of the seal 12 impact the water tightness of the seal. These dimensional aspects will be further described farther below. For this embodiment, the outside diameter of the seal 12 should be equal to or slightly greater than the inside diameter of the housing. The seal should be sufficiently thick (e.g., ¼" to ⅜") and it should have an inside diameter slightly smaller than the outside diameter of the beverage container 22 such that the compression of the seal 12 against the container results in a watertight seal. This prevents the ice and water mixture within the open chamber 17 between the container 22 and holder 19 from escaping during tipping of the holder in use.

Third Embodiment

The remaining embodiments each utilize certain components in common with the first embodiment of FIGS. 1-4 and like elements utilize the same reference numerals except being offset by 100, 200, etc.

Turning now to FIGS. 7-10, there is shown a third embodiment 100 in which the seal 112 comprises a two-part seal having a lower sealing portion 132 and an upper insertion portion 134. In this embodiment, the sealing portion 132 and insertion portion 134 are separate components secured directly together and/or each to the sleeve 111 in close abutting contact with each other.

The insertion portion 134 is in the shape of a wide ring sized to fit within the housing while extending above the opening of the housing. It is constructed of a stretchable/elastic, resiliently compressible and flexible closed cell foam rubber material and its characteristics impact the effectiveness of the insertion portion 134. For both the seal 12 of the first two embodiments and the insertion portion 134 of this embodiment, the following properties or characteristics (at minimum) have been found to affect the performance of the seal 12, 112:

(a) Elongation property of closed cell foam rubber—a minimum of 25 percent, with 400-600 percent offering superior stretch performance.

The elongation (elasticity, or amount stretched before breaking) is advantageous because it allows the seal 12, 112 to more easily receive a beverage container whose diameter is greater than the inside diameter of the seal. Without the insertion portions 15, 134, or a similar means to facilitate entry of the beverage container into the holder's opening, the bottom of the beverage container tends to grab the seal and cause collapsing of the housing side walls thereby making it difficult to insert the beverage container. Additionally, a more stretchable material at the upper portion of the seal 12, 112 makes it easier for the user to insert one's finger between the seal and beverage container to break the watertight grip of seal when it is necessary to release the positive pressure buildup upon insertion of the beverage container, or conversely to release the vacuum caused by removal of the beverage container upon consumption of the beverage. In short, it is easy for the user to stretch the seal away from the beverage container to increase the diameter of the seal and the housing's opening in order to slip the beverage container inside. Similarly, when removing, if a vacuum needs to be broken, it is easy to pull/stretch the seal away from the beverage container to facilitate breaking the seal.

(b) Compression deflection (hardness/softness)—the compression deflection should be at the low end of the range, or 2-9 PSI (i.e. 2-9 PSI "25% compression deflection" test means 2-9 PSI is required to deflect a 1 inch thick by 1 inch square piece down 25 percent to ¾ inch.) The softer (2-5 PSI) works better than the medium 5-9 PSI because less pressure is needed to compress the foam of the portion 15, 134 to facilitate easy insertion of the beverage container.

(c) Fabric laminate on the neoprene material of portions 15, 134—at minimum, it is desirable to have it on the beverage container facing side of the seal (e.g., inner surface 138 of FIG. 10), such that when the seal is inserted into the housing during manufacturing the nylon is located on the radially-inwardly facing surface of the seal. Additionally, it should be noted that, in the third embodiment, the sealing portion 132 and insertion portion 134 may be fastened together by a combination of sewing and adhesive, or other suitable means, prior to affixing to the housing sidewalls 111, thereby creating a subassembly that is then attached to the sleeve 111 as one piece. The fabric laminate—typically some type of elastic nylon—provides less friction than raw unlaminated neoprene and thereby facilitates easier insertion and removal of the beverage container. Also, nylon fabric laminated neoprene is widely available from a variety of suppliers. The radially outwardly facing surface can then be a smooth rubber side of the neoprene that can be glued to the inside of the housing; however, for aesthetic reasons, nylon laminate is desirable for the other side as well because nylon is available in a wide variety of colors whereas neoprene is typically black. Although a suitable adhesive is preferably used to attach the seal to the housing 10, it can be permanently attached by other means as will be known to those skilled in the art.

(d) Outside diameter of the insertion portions 15, 134—The outside diameter should be slightly greater to (or equal to) the inside diameter of the housing for two reasons. First, the compression creates a better fit with the housing and facilitates manufacturing by holding the insertion portion 15, 134 (and the seal in general) in place and applying pressure which help the adhesive bond. Second, the slightly greater outside diameter relative to the inside diameter of the housing creates a slightly flared or inverse conical shape to portion 15, 134 that extends above the top of the housing. This intended result provides a desirable way to reduce the friction on the beverage container when it is inserted because the raw edge 13, 113 of the neoprene is angled away from the bottom corner of the beverage container and therefore less like to "snag" or contact the beverage container. Additional the portion 15, 134 serves to guide the beverage container into the housing and helps ensure that the sidewalls of the beverage container make the first contact with the radially inward facing side of seal rather than with the base of the container, thereby facilitating its easy insertion. As indicated above, if the base of the container contacts the seal 12, 112, there is a tendency of the seal to securely grip the base of the container and not allow it to slide into the housing—and to cause the flexible walls of the housing to collapse inward. An additional benefit of the flared portion 15, 134 is it accommodates a greater range of beverage container diameters more easily.

(e) Thickness of the portion 15, 134—the insertion portion 15, 134 should be equal to or greater in thickness to the lower portion (e.g., sealing portion 132) of the seal. For example, in the third embodiment where different components are used for the sealing portion 132 and insertion portion 134, this latter component is preferably slightly (1/16 inch) greater in thickness than the sealing portion, or roughly 5/16 inch if the sealing portion 132 is 1/4 inch. This slightly greater thickness can be seen at 133 in FIG. 10 where the beverage container facing side of portion 134 contacts the opening side of sealing portion 132. The purpose of the slightly greater thickness for the portion 134 is to help ensure that the bottom or bottom corner of the beverage container does not "catch" the corner of the sealing portion 132 during insertion.

(f) Axial width of insertion portion 15, 134—the axial width of the portion 15, 134 should allow for sufficient material to extend above the housing to readily receive a beverage container by stretching of the material and by the conical flare of the portion 15, 134. Additionally, this portion needs to be long enough to make it easy to grasp when the user needs to. Testing has demonstrated that 1/2" above the opening to the housing is sufficient. Also, the portion 15, 134 should extend inside the housing; 1/8" to 3/16" is sufficient.

Figure 7:
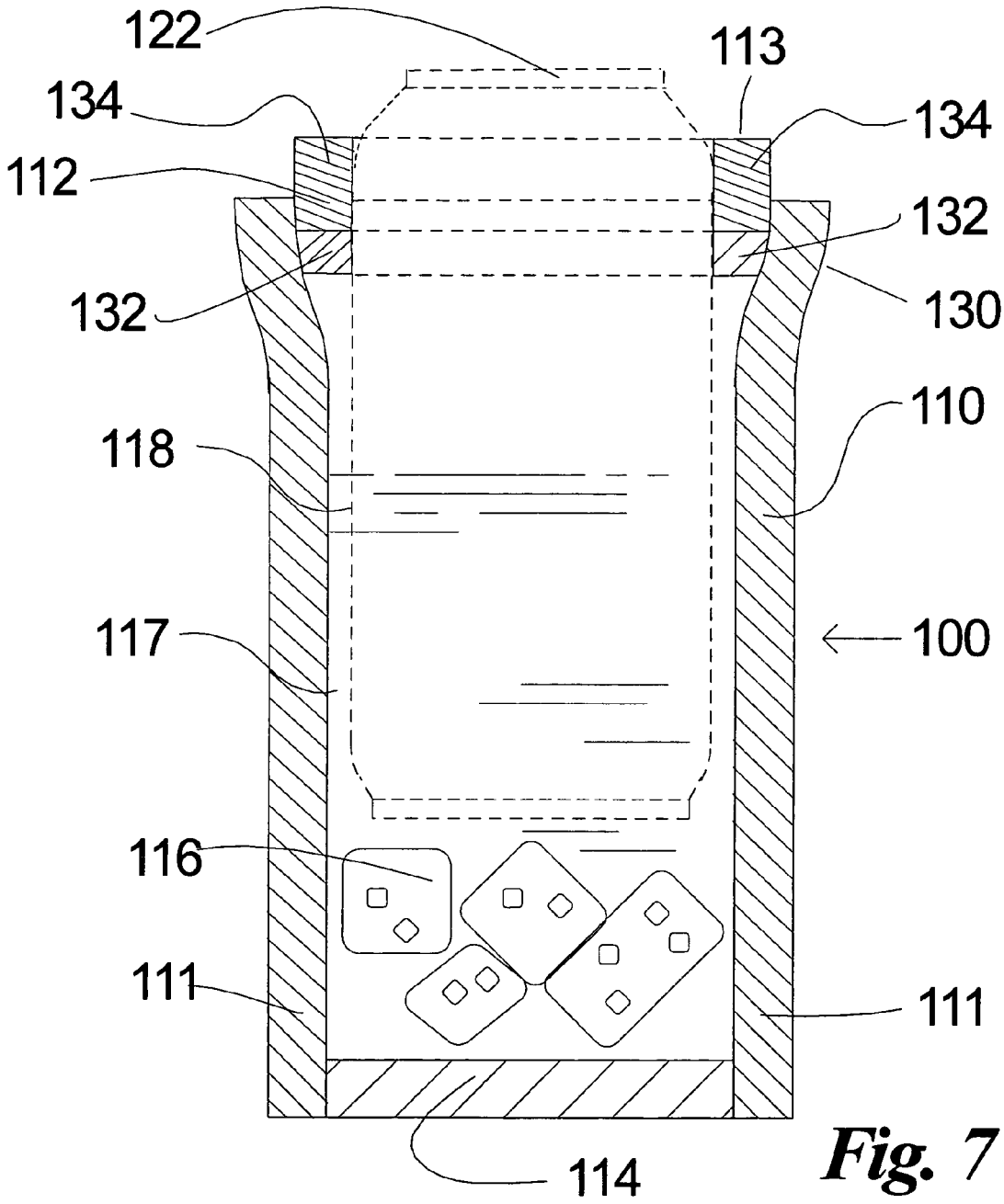
FIG. 7 is a side cut-away orthogonal view of a third embodiment that utilizes a two-part seal.
Figure 8:
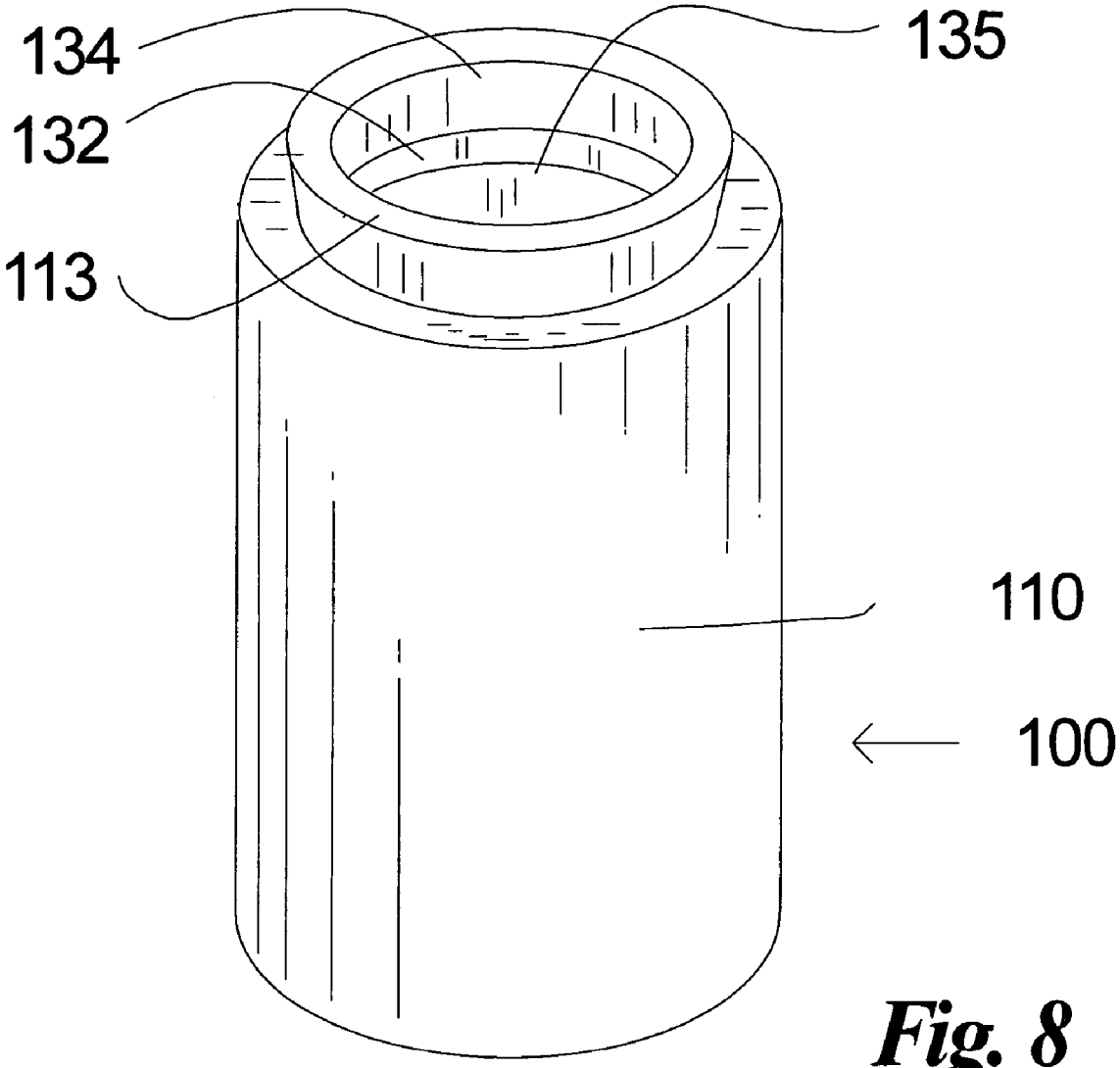
FIG. 8 is a side perspective view of the beverage holder of FIG. 7.
Figure 9:
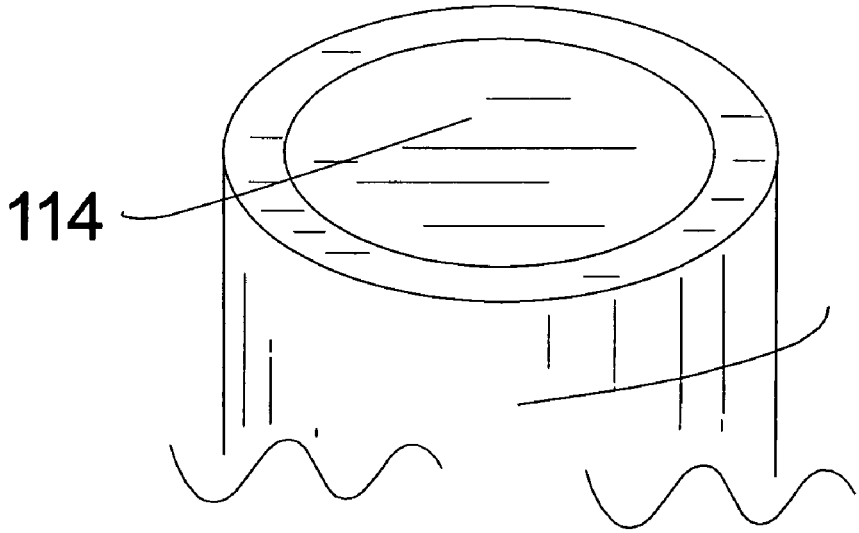
FIG. 9 is a side perspective view of the bottom of the beverage holder of FIG. 7.
Figure 10:
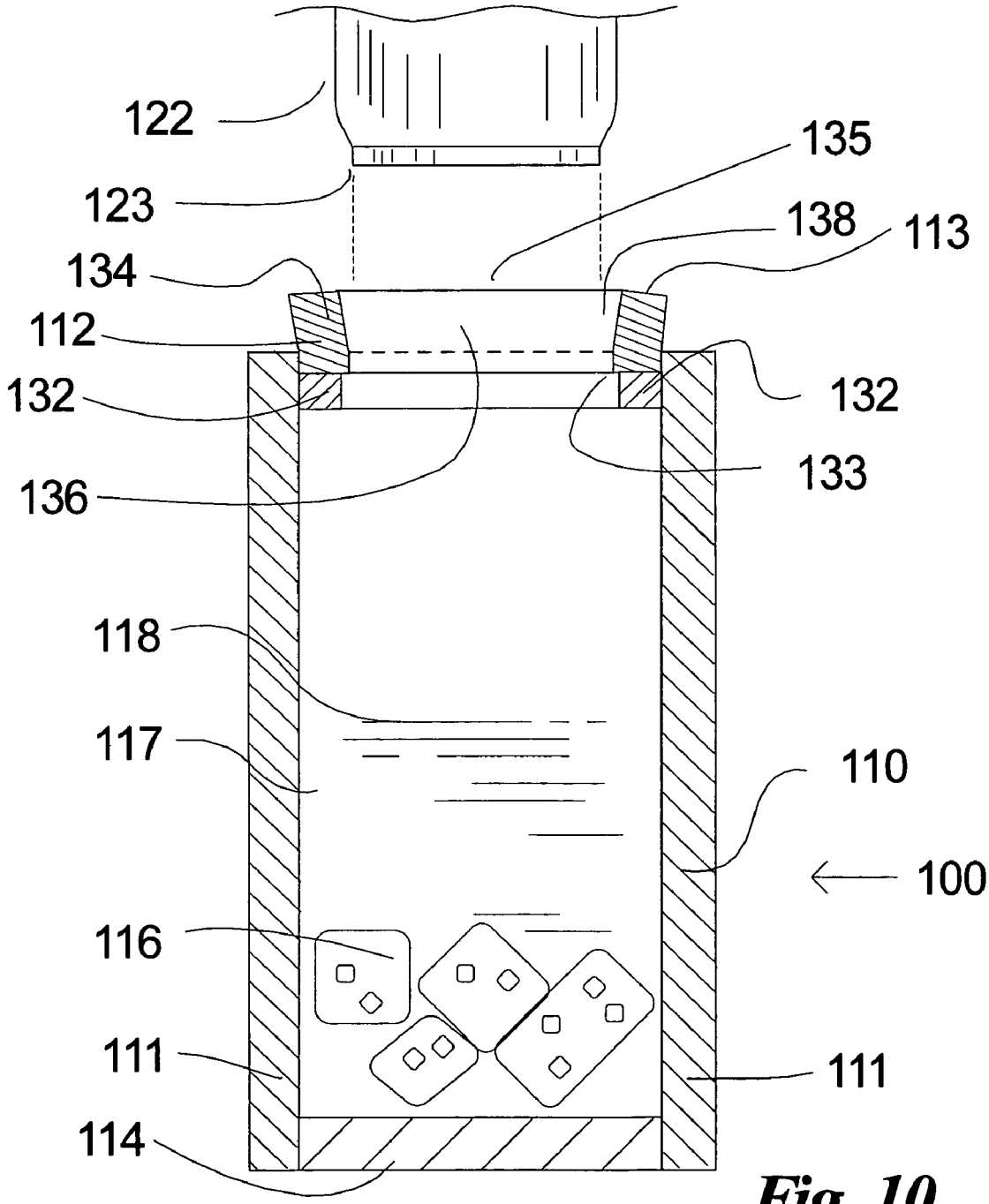
FIG. 10 is a side cut-away orthogonal view of a beverage container holder of FIG. 7 showing it prior to insertion of a 12 oz. beverage container illustrating how the upper portion of the seal is slightly tapered allowing it to receive the beverage container.

The sealing portion 132 may be made of either extruded neoprene tubing "baloney" cut to length or sheet neoprene of appropriate thickness that is die cut to the necessary dimensions. Desirably, it is constructed of a stretchable/elastic, resiliently compressible and flexible closed cell foam rubber material. Again, for the seal 12 of the first two embodiments, as well as for the sealing portion 132 of the third embodiment, the following properties or characteristics (at minimum) have been found to affect the performance of the seal:

(a) Elongation property of closed cell foam rubber—again, a minimum of 25 percent, with 400-600 percent offering superior seal performance. The elongation (elasticity, or amount stretched before breaking) is advantageous because the elongation of the seal 12 and sealing portion 132 allows them to more easily receive a beverage container whose diameter is greater than the inside diameter of the seal—while still applying sufficient inward pressure against the beverage container to create a satisfactory watertight seal. Additionally, an the use of an elastic material makes it easier for the user to stretch the insertion portion 15, 134 away from the beverage container to increase the diameter of the seal and the housing's opening in order to slip the beverage container inside and release the positive pressure that can be created. Similarly, when removing, if a vacuum needs to be broken, it is easy to pull/stretch the seal 12, 112 away from the beverage container to facilitate breaking the seal. Additionally, the effectiveness of the seal is increased by the inward pressure caused by the elasticity of housing as illustrated in FIGS. 4 and 7 by the bulges 30, 130 of the housing at the lower portion of the seal. The bulge 30, 130 is the result of the relative dimensions of the sleeve 11, 111, seal 12, 112 and the container, as well as from other characteristics of the materials, and this construction provides an inward sealing force that is a combination of inward pressure from both the sleeve and the seal.

(b) Compression deflection (hardness/softness)—the compression deflection should be at the low end of the range, or 2-9 PSI (i.e. 2-9 PSI "25% compression deflection" test means 2-9 PSI is required to deflect a 1 inch thick by 1 inch square piece down 25 percent to 3/4 inch.) The softer (2-5 PSI) works better than the medium 5-9 PSI because less pressure is needed to compress the foam of the seal to facilitate easy insertion of the beverage container and to create a watertight seal. Additionally, a softer sealing portion tends to conform better to beverage containers that are not perfectly cylindrical in shape as are some water or soda bottles.

(c) The dimensions of the seal 12, 112 affect the function of the holder. The overall dimensions (thickness, width, inside diameter, and outside diameter) of the seal 12, 112 impact the water tightness of the seal.

(1) Thickness of seal material—it should be sufficiently thick (e.g., 1/4 to 3/8") along with the relatively soft or medium compression deflection property, such that the compression of the seal against the beverage container results in a watertight seal over the intended range of beverage container diameters targeted for a particular holder model. The watertight seal prevents the ice and water mixture within the open chamber 17, 117 between the container and holder from escaping during tipping of the holder in use. Neoprene manufacturers state that the compression percentage to achieve a watertight seal is in the range of 25%—though this may vary depending on the individual properties of a given batch of neoprene. If it is desirable to accommodate a greater range of beverage container diameters, then the seal thickness can be increased along with appropriate adjustments to the related dimensions of the inside diameter of the seal, and the inside diameter of the housing. The properties of the housing material along with its dimensions—particularly the housing wall thickness and inside diameter impact this range.

(2) Axial width of lower portion of the seal—the axial width of the lower portion (e.g., portion 132 of seal 112) should allow for sufficient surface area to provide for a good seal and good adhesion with the housing. Testing has demonstrated that 3/16" to 3/8" for the seal provides a good watertight seal and widths greater than this tend to increase the friction when inserting or removing the beverage container. Desirably, the amount of friction between the seal and container should be enough to hold the container axially in place within the holder so that no spacer or pedestal such as used in the aforementioned U.S. Pat. No. 6,516,967 is needed. The amount of friction between seal and container is a function of all the properties of both the seal and housing. Additionally, a particular wide seal, 3/4" or greater for example, may be disadvantageous since it will make it more difficult to break the watertight seal when necessary to adjust the pressure differential.

(3) Inside diameter of lower portion of the seal—seal 12 and at least the lower portion of seal 112 have an inside diameter slightly smaller than the outside diameter of the beverage container such that the compression of the seal against the container results in a watertight seal. Testing has indicated that the inside diameter should range from 2.1 to 2.6 inches; the lower end to target standard 12 ounce cans and bottles whereas the upper end is more appropriate for 24 ounce water bottles. For example, the seal can have an inside diameter of 2.1 inches with a seal thickness of 6 millimeters and 3 PSI compression deflection, and can be covered by a laminated nylon fabric. It should be noted that the inside diameter values above are measured after the seal has been attached by glue or other means to the housing in a finished product and the inside diameter measurement is taken at the top of the housing, where the housing and seal meet.

(4) Outside diameter of lower portion of the seal—The outside diameter of the lower portion of the seal should be slightly greater to (or equal to) the inside diameter of the housing. During assembly and insertion of the seal, its diameter must be slightly compressed to fit inside the housing. The resultant slight outward pressure of the seal at its lower portion against the housing creates a better fit and facilitates manufacturing by holding the seal in place and applying pressure which help the adhesive bond. Second, as discussed previously in the section on the insertion portion, the slightly greater outside diameter of the seal relative to the inside diameter of the housing gives the upper (insertion) portion 15, 134 a slightly flared or inverse conical shape that extends above the top of the housing.

The relationship and position of the seal with respect to the housing is affects the function of the holder. For example, as can be seen from FIGS. 7, 8, and 10 for the third embodiment, the insertion portion 134 is concentrically positioned near the top opening of the housing 110 with the top of the portion 134 slightly above (3/8") the top plane of housing 110. The bottom of the portion 134 extends slightly below (1/8" to 1/4") the top plane of the housing 110. And the sealing portion 132 is positioned directly below the portion 134. As indicated, the seal may be assembled—by sewing and/or gluing the bottom of the insertion portion 134 to the top of the sealing portion 132—prior to affixing to the housing. It is desirable to securely affix the radially outward facing side of the sealing portion to the radially inward facing side of the housing. If the portions 132 and 134 extend too far into the housing, or the insertion portion 134 extends too far above the housing, or both, then it becomes increasing difficult for the user to break the watertight seal when necessary to equalize pressure. The seal can be positioned just 1/8" to 1/4" below the top of housing 110, and the user simply grasps the portion 134 and pulls in a radially outward direction to break the seal between the beverage container 122 and the sealing portion 132. If the sealing portion 132 is much deeper within the housing, then it will be more difficult to break the seal in this way due to several factors. One, outward pull on the portion 134 will have less pull on the sealing portion 132 the deeper it is in the housing. Two, the inward pressure of the elasticity of the housing 110 will be greater on the sealing portion 132 the deeper it is in the housing since it farther away from the relatively elastic opening 135 of the housing.

In summary, the combination of the seal 12, 112 and elastic housing design creates several advantages:

(a) The built-in venting system from the elasticity of the seal and housing eliminates the need for either a vent hole and plug, or a separate cap/lid as in prior art. As previously discussed, stretching the top opening to pull it away from the beverage container is sometimes necessary to release the pressure buildup when inserting a beverage container. Conversely, stretching the housing material away from the beverage container is sometimes necessary to release the vacuum created when trying to remove the beverage container. The user can stretch the housing and seal material at the opening by simply inserting a thumb between the seal and the beverage container and pulling away from the beverage container thereby creating an opening into the chamber area 17, 117 of the housing.

(b) The chamber area 17, 117 can flex inward reducing the overall volume of the chamber area when removing the beverage container to help alleviate the problem of the vacuum created—assuming the chamber area is not overfilled with the ice and water mixture.

(c) Facilitates easier insertion and removal of the beverage container;

(d) Accommodates greater range of beverage container diameters while still allowing ease of insertion and a watertight seal;

(e) Facilitates manufacture and decreases manufacturing expense. Since the insertion portion 15, 134 extends beyond the top of the housing, it is not critical to have that portion attached (by adhesive or other means) to the housing all the way to the very top edge of the housing, as it would if the top edge of the portion 15, 134 were to end at the top of the housing. This is because the raw end 13, 113 of the insertion portion is less likely to come in contact with the beverage container, which puts a significant stress on the seam between the seal and the housing and may cause the separation between the seal and the housing. If the adhesive does not need to be applied very close to the top of the housing, then it is less likely that excess glue will spill out from under the seal and onto the top edge of the housing thereby necessitating cleanup during manufacturing or possible rejection of the piece.

(f) Stretching of the opening and the inward pressure caused by elasticity housing as illustrated by the bulge 30, 130 of the housing on the seal combined with the elasticity of the seal and the resulting compression helps to provide a watertight to keep the water and/or ice mixture from leaking.

(g) Stretching helps to provide an airtight seal even if water and ice are not used thereby enhancing the insulating properties.

(h) Stretching helps to provide a way to accommodate a greater range of beverage container diameters while still making it easy both to insert and remove the containers.

(i) The friction of the compression caused by stretching holds the beverage container in place vertically above the bottom of the housing so that a pedestal in the base of the holder is unnecessary. In addition, the seal positions the beverage container in the center of the housing so that there is space between the beverage container and the walls of the housing, which is desirable since it allows the ice and water mixture to be contact directly with the walls of the beverage containing permitting conductive transfer of the cooling effect.

In use, water and ice are placed inside the holder to a depth of one-third to one half of the height of the holder. Next, the beverage container is inserted into the holder while pushing and twisting the container until the container is substantially inside the holder (⅘th of the way in). Depending on the volume of water and ice mixture relative to the size/volume of the beverage container, it may be desirable to break the seal between the container and the holder by grasping the beverage container top with one hand and using the other hand to pull at least the upper portion of the seal radially outward from the beverage container and, if necessary, inserting one's thumb or forefinger between the seal and beverage container in order to break the seal and to release the pressure that may have resulted from inserting the container into the holder. Similarly, when one wants to remove the beverage container, one simply pulls back the stretchable top opening thereby breaking the seal and releasing the vacuum caused by removing the container. This is an advantage of using stretchable material for the housing and the seal; otherwise it would be very difficult to pull the beverage container out of the holder due to the vacuum created. Additionally, the beverage container may be removed by grasping the beverage container with one hand and squeezing the bottom of the housing with the other hand while twisting the container as it is removed.

When the beverage container is seated within the holder, it is in direct contact with the ice and water mixture thereby providing a cooling effect by conduction. Also, when the user tilts the holder (with an open beverage container inside), the seal prevents the ice and water mixture from leaking. Even if the user does not want to use the holder with the ice and water mixture, the holder is still more effective than many conventional holders because the seal helps to minimize the heat loss by convention (warm air flow around holders coming in contact with the cooler beverage container, thereby warming it).

The foregoing considerations concerning materials, dimensions, and construction of the first three embodiments of the holder are applicable to the following remaining embodiments and therefore will not be repeated.

Fourth Embodiment

Figure 11:
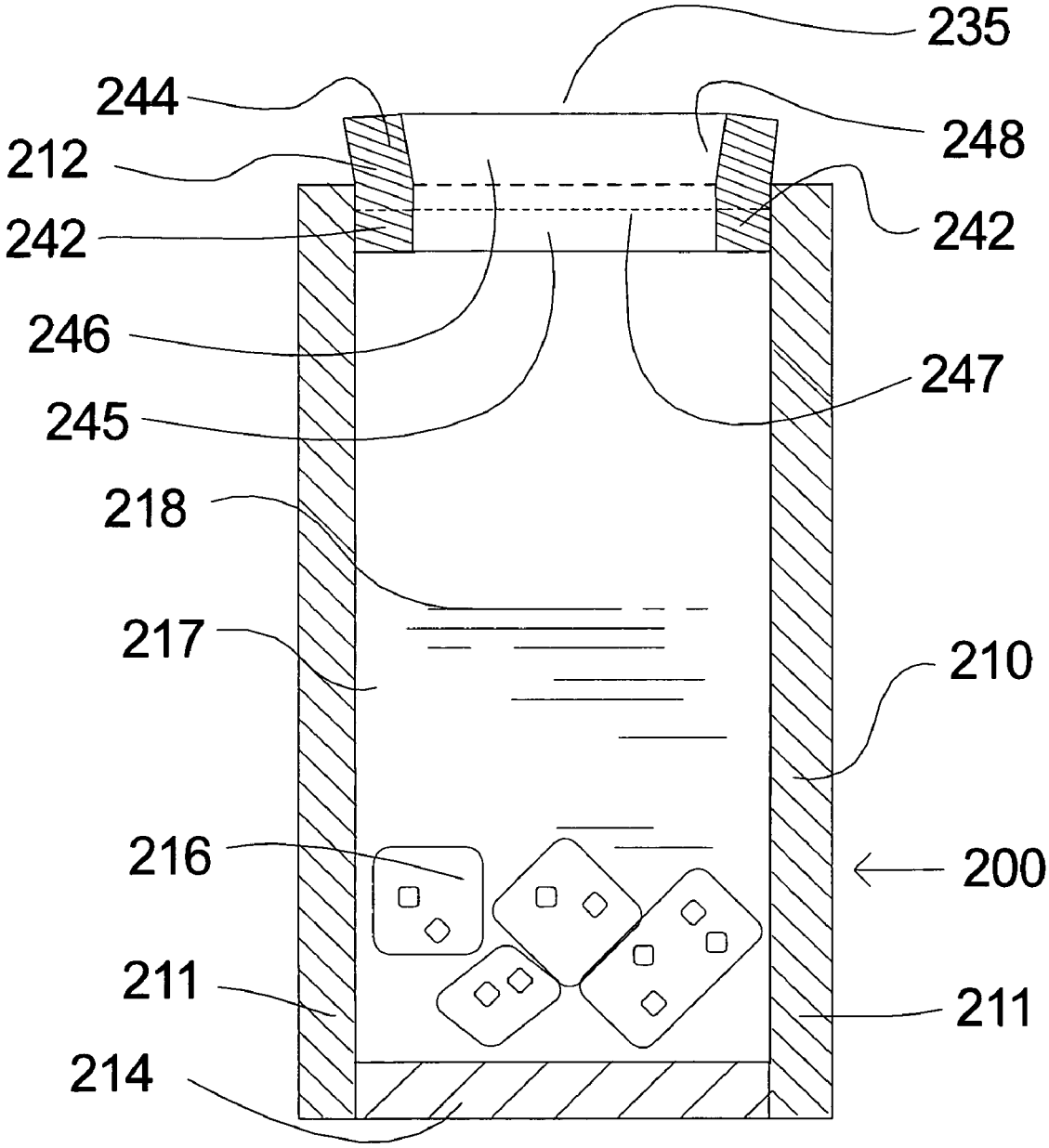
FIG. 11 is a side cut-away orthogonal view of a fourth embodiment of the invention illustrating a unitary two-part seal.

Referring now to FIG. 11, a fourth embodiment 200 is shown. The seal 412 used in this embodiment comprises a one-piece seal formed from an insertion portion 244 that is unitary with the lower, sealing portion 242. This construction is similar to that of the third embodiment, except that in the third embodiment, the radially inward surface of the insertion portion 134 was nylon laminated neoprene and the sealing portion 132 was unlaminated neoprene, whereas in this embodiment 200, the radially inward facing side 248 of insertion portion 244 (above the imaginary line 247) does not have a nylon fabric laminate but is smooth neoprene unlaminated to improve the watertight seal of seal 212. Thus, the entire inner surface of the seal 212 (both the sealing portion 242 and insertion portion 244) is unlaminated neoprene.

Fifth Embodiment

Figure 12:
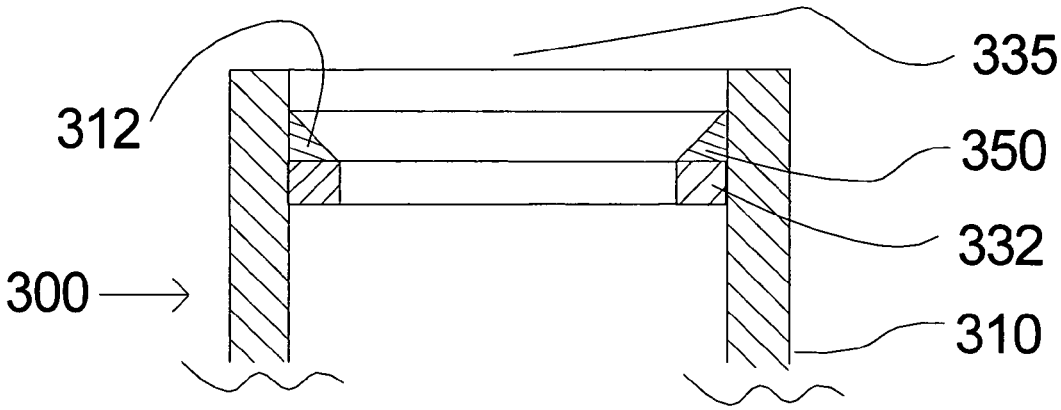
FIG. 12 is a side cut-away orthogonal view of a fifth embodiment of the invention illustrating a tapered two-piece seal.

Referring now to FIG. 12, a fifth embodiment 300 is shown in which the flared insertion portion of the seal 312 extending out of the housing has been eliminated and replaced by a tapered seal piece 350. The lower sealing portion 332 can be the same the one in FIG. 7, but placed about ¾ inch lower in the housing. The tapered seal piece 350 acts to facilitate the insertion of the beverage container in much the same way as the flared insertion portions does by preventing the bottom corner of the beverage container from "grabbing" on the sealing portion 332. The tapered seal piece 350 may be made of the same neoprene material preferably with a nylon laminate on the beverage container facing tapered side. Alternatively, it may be made of an elastic material with a relatively low coefficient of friction with the beverage container.

Figure 13:
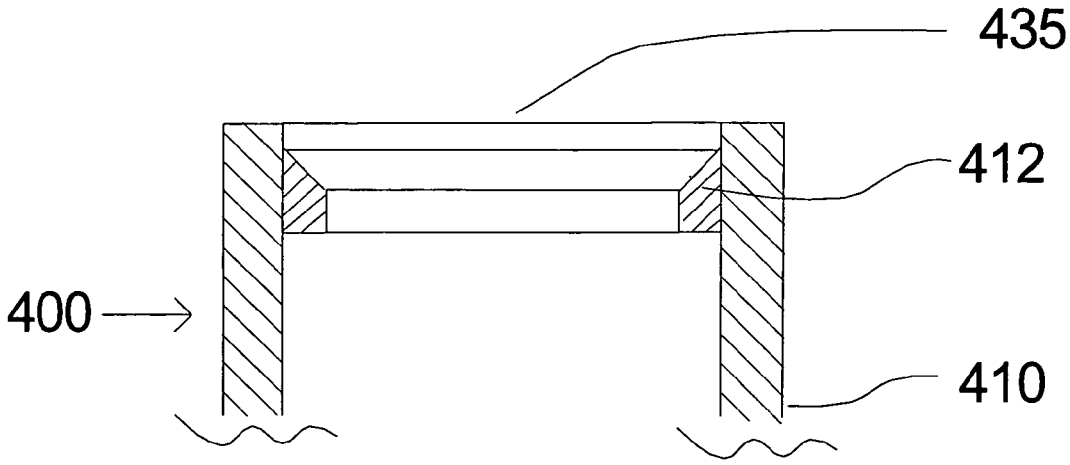
FIG. 13 is a side cut-away orthogonal view of the fifth embodiment of the invention of FIG. 12, but constructed in one piece.

As shown in FIG. 13, this fifth embodiment can instead be made from a one-piece seal 412 in which the tapered portion and sealing portion comprise a unitary piece of neoprene or other suitable material.

Sixth Embodiment

Figure 14A:
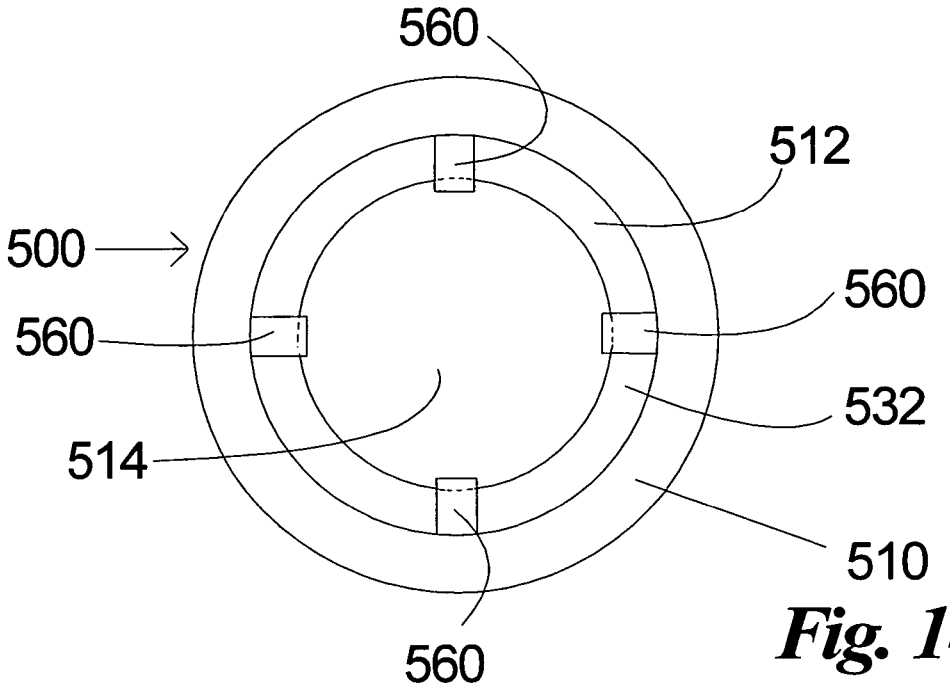
FIG. 14*a* is a top view of a sixth embodiment of the invention illustrating an alternative two-part seal.
Figure 14B:
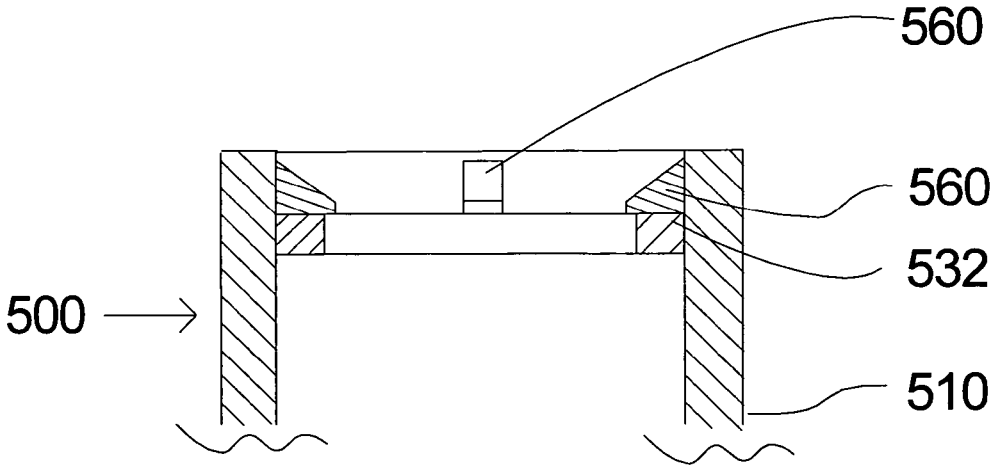
FIG. 14*b* is a side cut-away orthogonal view of the sixth embodiment of the invention shown in FIG. 14*a;*

Referring now to FIGS. 14*a* and 14*b*, a sixth embodiment 500 is shown in which again the flared insertion portion has been eliminated and four insertion tabs 560 have been added at the top of the seal 512. The sealing portion 532 can be the same the one in FIG. 7, but placed about ¾ inch lower in the housing and it has four tapered insertion tabs 560 attached to the top of it. The tapered seal pieces 560 act to facilitate the insertion of the beverage container in much the same way as the sleeve does by preventing the bottom corner of the beverage container from "grabbing" on the sealing portion 532. The tapered seal pieces 560 may be made of the same neoprene material preferably with a nylon laminate on the beverage container facing tapered side. Alternatively, it may be made of molded plastic material.

Seventh Embodiment

Figure 15:
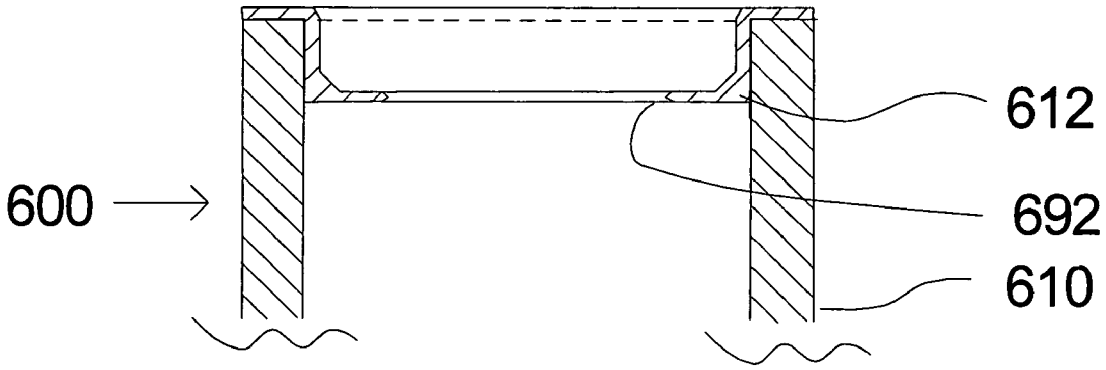
FIG. 15 is a side cut-away orthogonal view of a seventh embodiment of the invention that utilizes a molded, thin-walled seal.

Referring now to FIG. 15, a seventh embodiment 600 is shown in which the two-part neoprene seal has been replaced with a molded seal 612. The tapered beverage container facing side of the seal 612 acts to facilitate the insertion of the beverage container. A thermoplastic rubber compound with compliant properties may be used for the seal 612. And the seal of this material may be affixed in the same manner as the neoprene seal or attached to the top of housing in addition to the inside walls of the housing as previous seal embodiments. Depending on the thermoplastic rubber compound, it may be possible to reduce to the axial width to $1/16^{th}$ to $1/8^{th}$ inch as measured at 692 on the seal. Alternately, it may be possible to overmold the seal 612 to a molded housing 610 created from Tuffoam™ brand foam or similar material.

Eighth Embodiment

Figure 16:
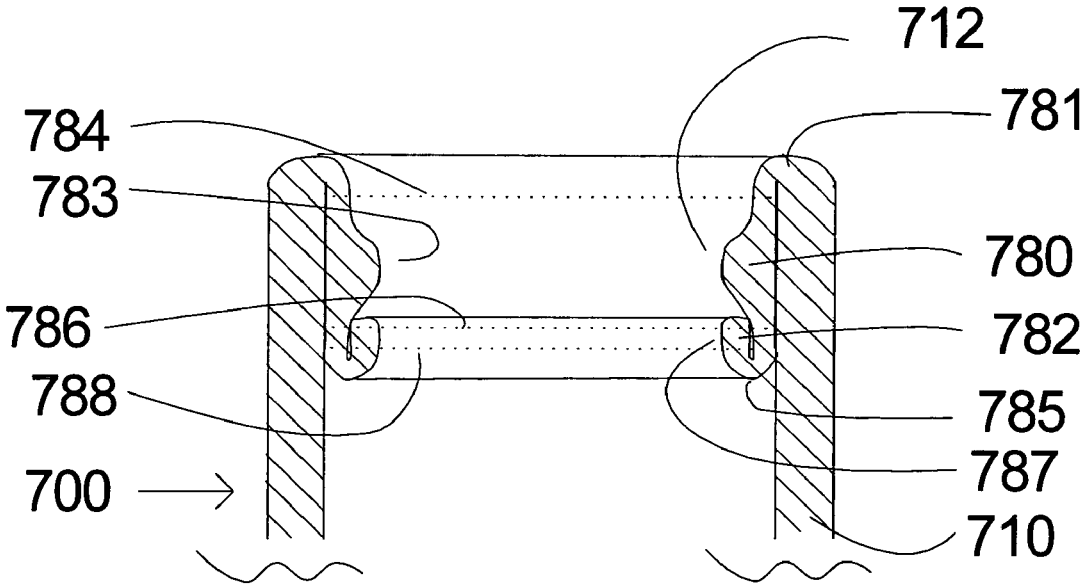
FIG. 16 is a side cut-away orthogonal view of an eighth embodiment of the invention in which the two-part seal is formed along with the housing from a unitary piece of neoprene.

FIG. 16 refers to an eighth embodiment 700 of the invention. It has the same primary components as the embodiment shown in FIG. 7; however, in this eighth embodiment the housing 710 and seal 712 are constructed from a single unitary piece of neoprene that has nylon laminate on one side and raw smooth neoprene on the other. The initial sheet of neoprene before sewing, or assembly, must be of sufficient height and width to create the finished product of desired dimensions for the target size beverage container. The thickness of the neoprene sheet material can be ¼". The first step in the construction is to fold the neoprene sheet material at fold line 785 and sew two seams 786 and 788 about 3/16" apart through the folded neoprene so that a sealing portion 782 can be created. The neoprene sheet should be folded in such as way that the unlaminated side of the neoprene sheet after the fold 785 and sewing seams at 786 and 788 is at the location indicated by reference numeral 787, which will be the beverage container radially inward facing side of the seal. Next, a seam 784 is sewn through one thickness of the sheet neoprene material at 784, which is about ¾" from the fold 785; this creates what will be the insertion portion 780. Then the neoprene sheet is folded at 781 and adhesive is applied along the unlaminated neoprene from the fold 781 to the fold 785 thereby securing what has become the seal 712. The seam 784 creates the taper to seal 712 that is desirable to prevent the sealing portion 782 from "grabbing" the beverage container. Note that the fabric laminate side 783 is on the beverage container facing side of the insertion portion 780. The next step is to create the housing by forming a cylindrical shape with the neoprene material making sure that the sealing portion 782 is on the radially inward side of the newly formed housing. The raw edges of the neoprene forming housing may sewn together to initially secure them, then it will be necessary to glue them with a suitable watertight adhesive such as Aquaseal. Rather than using sheet material, tubular neoprene can be used to eliminate the need to roll the sheet material into a cylindrical housing and the subsequent gluing. The bottom may be formed of material and attached in the same manner as previously disclosed embodiments.

The illustrated embodiments described above provides some or all of the following features and advantages:

1. No valves are required to release vacuum when removing or inserting the beverage container
2. One piece construction—does not require a separate lid or cap containing the seal assembly
3. Not only insulates but cools beverage
4. "Rechargeable" when ice and water coolant warms simply with more ice and water without requiring refreezing of "refreezable" gel components
5. Effective method to substantially prevent leakage of the ice and water refrigerant
6. Low cost to manufacture with materials and processes already used predominately in the industry
7. Easy to print promotional messages on with existing equipment already commonly used in the industry
8. Superior insulation structure
9. Simplicity of design
10. No "sweat" or condensation buildup on exterior of holder
11. Accommodate a wide range of beverage container diameters securely—while allowing relatively easy container removal
12. Portable size It is to be understood that the foregoing description is not a description of the invention itself, but of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, in the third embodiment of FIGS. 7-10, the seal 112 could be made from a single piece of neoprene that is only covered with a nylon laminate at its upper, insertion portion 134. All such other embodiments, changes, and modifications are intended to come within the scope of the appended claims.

As used in this specification and claims, the terms "for example" and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A holder for use with a beverage container, comprising:

a watertight housing that includes a tubular sleeve and bottom, said sleeve having first and second ends with said sleeve being open at said first end and being closed off by said bottom at said second end, said sleeve comprising a closed cell foam rubber; and an upper seal located adjacent said first end of said sleeve, said upper seal comprising a closed cell foam rubber and being permanently attached to an inner surface of said sleeve adjacent said first end, said seal extending radially inwardly of said sleeve, said upper seal including an upper insertion portion and a separate lower sealing portion each of which includes a radially inwardly-facing surface with said inwardly-facing surface of said upper insertion portion exhibiting less friction than said inwardly-facing surface of said lower sealing portion, said upper insertion portion being attached to said inner surface of said sleeve at a location above said lower sealing portion and extending outwardly from said sleeve beyond said first end, and wherein said housing and seal are so dimensioned relative to the beverage container such that, when the beverage container is inserted into said first end, said sleeve and said seal provide a radially-inward force on the beverage container that forms a watertight connection between said seal and the beverage container, said watertight connection being sufficient to suspend the beverage container within said housing such that a bottom of the beverage container is spaced above said bottom of said housing and is unsupported within said holder, wherein said watertight connection in combination with said watertight housing forms a sealed refrigerant space extending from said bottom of said housing to said upper seal;

wherein said inwardly-facing surface of said upper insertion portion comprises a different material than said inwardly-facing surface of said lower sealing portion;

wherein said upper insertion portion comprises a ring of closed cell foam rubber having its inwardly-facing surface being formed of a material having a low coefficient of friction relative to said inwardly-facing surface of said lower sealing portion; and wherein said lower sealing portion comprises closed cell foam rubber having its inwardly-facing surface formed from an exposed portion of the foam rubber and said inwardly-facing surface of said ring comprises a fabric.

2. An insulated holder for maintaining a beverage contained within an aluminum can at a reduced temperature relative to an ambient temperature, said insulated holder comprising:

a watertight housing that includes a bottom and a tubular sleeve, said sleeve having first and second ends with said sleeve comprising a cylindrical tube of closed cell foam rubber that is elastic and that is open at said first end and is closed off by said bottom at said second end, wherein said bottom is attached to said sleeve at said second end by a watertight adhesive; and an upper seal located adjacent said first end of said sleeve, said upper seal comprising a closed cell foam rubber directly attached via adhesive to an inner surface of said sleeve adjacent said first end, said seal extending radially inwardly of said sleeve, said upper seal including an insertion portion and lower sealing portion, said lower sealing portion having a radially inwardly-facing surface comprising unlaminated neoprene, said upper insertion portion being located above said lower sealing portion and extending outwardly from said sleeve beyond said first end and having an inner surface that flares upwardly and outwardly in a direction away from said first end;

wherein said insertion portion has a radially inwardly-facing surface that, during insertion of the aluminum can into said housing, exhibits less friction between the aluminum can and said inwardly-facing surface than exists between the aluminum can and said lower sealing portion, and wherein said housing and upper seal are so dimensioned relative to the aluminum can such that, when the aluminum can is inserted into said first end, said sleeve and said upper seal provide a radially-inward force on the aluminum can that forms a watertight connection between said lower sealing portion and the aluminum can said watertight connection being sufficient to suspend the aluminum can and beverage within said housing such that a bottom of the aluminum is spaced above said bottom of said housing, wherein said watertight connection in combination with said watertight housing forms a sealed refrigerant space extending from said bottom of said housing to said upper seal.

3. An insulated holder as defined in claim 2, wherein said closed cell foam rubber of said sleeve and upper insertion portion comprises neoprene.

4. An insulated holder as defined in claim 2, wherein said closed cell foam rubber of said upper seal has an elongation property of greater than 25% and a compression deflection within the range of 2-9 psi.

5. An insulated holder as defined in claim 4, wherein said elongation property is within the range of 400-600% and said compression deflection is within the range of 2-5 psi.

6. An insulated holder as defined in claim 2, wherein said insertion portion is tapered radially inwardly in a direction extending from said first end towards said second end.

7. An insulated holder as defined in claim 2, wherein said upper seal extends outwardly from said sleeve beyond said first end.

8. An insulated holder for maintaining a beverage contained within an aluminum can at a reduced temperature relative to an ambient temperature, said insulated holder comprising:

a watertight housing that includes a bottom and a tubular sleeve, said sleeve having first and second ends with said sleeve comprising a cylindrical tube of closed cell foam rubber that is open at said first end and is closed off by said bottom at said second end, wherein said bottom is attached to said sleeve at said second end by a watertight adhesive; and an upper insertion portion comprised of elastic closed cell foam rubber located adjacent said first end of said sleeve, said upper insertion portion being attached to an inner surface of said sleeve adjacent said first end, and said upper insertion portion extending radially inwardly of said sleeve and outwardly from said sleeve beyond said first end, said upper insertion portion having an inner surface that flares upwardly and outwardly in a direction away from said first end;

a lower sealing portion directly attached via adhesive to the inner surface of said sleeve adjacent the upper insertion portion and being positioned lower than said upper insertion portion, wherein said upper insertion portion has a radially inwardly-facing surface that, during insertion of the aluminum can into said housing, exhibits less friction between the aluminum can and said inwardly-facing surface than exists between the aluminum can and said lower sealing portion, and wherein said housing and lower sealing portion are so dimensioned relative to the aluminum can so as to provide a radially-inward force on the aluminum can that forms a watertight connection between said lower sealing portion and the aluminum can when the aluminum can is inserted into said first end, said watertight connection being sufficient to suspend the aluminum can and beverage within said housing such that a bottom of the aluminum can is spaced above said bottom of said housing and out of contact with said holder, wherein said watertight connection in combination with said watertight housing forms a sealed refrigerant space extending from said bottom of said housing to said lower sealing portion.

9. An insulated holder as defined in claim 8, wherein said lower sealing portion has an inner diameter that is greater than an inner diameter of the upper insertion portion.

* * * * *